US005833108A

United States Patent [19]

Chinzei et al.

[11] Patent Number: 5,833,108

[45] Date of Patent: Nov. 10, 1998

[54] PAPER DELIVERY DEVICE

[75] Inventors: Kiyoshi Chinzei; Hiroshi Yamada, both of Hyogo, Japan

[73] Assignee: Fujitsu Limited, Kawasaki, Japan

[21] Appl. No.: 499,133

[22] Filed: Jul. 7, 1995

[30] Foreign Application Priority Data

Jul. 11, 1994 [JP] Japan ..... 6-158433

[51] Int. Cl.[6] ..... B65H 20/00

[52] U.S. Cl. ..... 226/177; 226/176; 226/187

[58] Field of Search ..... 226/176, 177, 226/181, 187, 11, 91, 169

[56] References Cited

U.S. PATENT DOCUMENTS

| | | | |
|---|---|---|---|
| 3,669,331 | 6/1972 | Renold | 226/187 |
| 3,841,606 | 10/1974 | Declercq | 226/187 |
| 3,985,277 | 10/1976 | Wright | 226/187 |
| 4,167,954 | 9/1979 | Karcher | 226/177 |
| 4,611,939 | 9/1986 | Fujiwara | 226/187 |
| 4,790,164 | 12/1988 | Rothe | 226/177 |
| 4,828,158 | 5/1989 | Kinoshita et al. | 226/187 |
| 4,846,388 | 7/1989 | Benbow | 226/187 |
| 5,129,749 | 7/1992 | Sato | 226/187 |
| 5,217,152 | 6/1993 | Suzuki et al. | 226/187 |
| 5,221,035 | 6/1993 | Suzuki et al. | 226/187 |
| 5,295,617 | 3/1994 | Park | 226/181 |

FOREIGN PATENT DOCUMENTS

| | | | |
|---|---|---|---|
| 1042917 | 5/1957 | Germany | 226/187 |
| 63-4978 | 1/1988 | Japan . | |
| 63-57452 | 3/1988 | Japan . | |
| 64-64943 | 3/1989 | Japan . | |
| 2-30569 | 1/1990 | Japan . | |
| 0182653 | 7/1990 | Japan | 226/177 |
| 5070007 | 3/1993 | Japan | 226/177 |

*Primary Examiner*—Charles A. Marmor
*Assistant Examiner*—Matthew A. Kaness
*Attorney, Agent, or Firm*—Armstrong, Westerman, Hattori, McLeland & Naughton

[57] ABSTRACT

A paper delivery device in which paper is delivered, being put between pinch rollers and a delivery roller. Such paper delivery device is comprised of a lever that is operated to pivot to at least a first position, a second position and a third position; a locking device locking a pinch roller unit, which supports the pinch rollers, at a predetermined locked position; a pressing force changing device for changing the pressing force of the pinch rollers applied to the delivery roller to the high level or low level, by pivoting the switching means between the first position and the second position; and an unlocking device for unlocking the pinch roller unit locked by the locking device when the lever is operated to pivot from the second position to the third position.

15 Claims, 16 Drawing Sheets

PAPER DELIVERY DEVICE

BACKGROUND OF THE INVENTION (1) Field of the Invention

The present invention relates to a paper delivery device, and more particularly to a paper delivery device for use in an image forming apparatus such as a laser printer using continuous paper.

(2) Description of the Prior Art

FIG. 18 shows an image forming apparatus such as a laser printer for forming images on the surface of continuous paper, in which continuous paper 103 which has been delivered from a hopper unit 101 by means of a tractor 102 passes a transfer unit 104 and a fixing unit 105 successively. The continuous paper 103 is then turned by a paper delivery device 106 positioned downstream of the fixing unit 105 and is finally stacked on a stacker unit 107, being folded such that its front face and back face alternately face up. The paper delivery device 106 is composed of upper and lower paper guides for guiding the continuous paper 103 and delivery rollers 106*a* and pinch rollers 106*b* which pinch the continuous paper 103 in cooperation to deliver it along the paper guides. In this example, each delivery roller 106*a* are is respectively arranged in the upstream side and downstream side of the paper guides, and the delivery rollers 106*a* and the pinch rollers 106*b*, which are arranged in opposing relationship, provide desired tension to the continuous paper 103.

Generally, such a paper delivery device 106 includes an unlock mechanism and a pinch pressure changing mechanism. The unlock mechanism opens the pinch roller units by releasing the pinch rollers 106*b* from their locked condition through lever operation when removing jammed paper. The pinch pressure changing mechanism switches the pressure of the pinch rollers 106*b* between, for example, two levels (i.e., high level and low level) through lever operation according to the thickness of the continuous paper 103 to be used. The paper delivery device 106 also includes an opening mechanism for opening the pinch roller units in order to check printing quality, apart from paper jam disposal. The opening mechanism is designed such that while either one of the pinch roller units is opened or closed (the open position is indicated by chain line in FIG. 18), the other pinch roller unit restrains the continuous paper 103, which allows the portion of the continuous paper 103 between the photosensitive drum and the fixing unit to rise up during a check of printing quality so that unfixed data on the continuous paper 103 can be prevented from rubbing against the paper guides.

SUMMARY OF THE INVENTION

The prior art paper delivery device suffers from several disadvantages. First, the operation lever for the unlock mechanism and the operation lever for the pinch pressure changing mechanism are separately provided in the paper delivery device, and therefore the operation of these operation levers is troublesome. Another disadvantage is such that since the action of the pinch roller units for removing jammed paper differs from that for a check of printing quality, a very complicated mechanism is required. In addition, the prior art device needs two pinch roller units because there are two delivery rollers, which also makes the structure complicated and leads to high manufacturing cost.

The invention has been made taking these disadvantages into account, and therefore, one of the objects of the invention is to provide a low-cost paper delivery device of a simple structure which requires less components, by virtue of the operation lever which can be used for changing pinch pressure as well as for releasing a pinch roller unit.

The foregoing object can be achieved by a paper delivery device according to the invention in which paper is delivered being put between pinch rollers and a delivery roller, the device comprising:

(a) switching means which is operated to pivot to at least a first position, a second position and a third position;

(b) lock means for locking a pinch roller unit which supports the pinch rollers at a predetermined locked position;

(c) pressing force changing means for changing the pressing force of the pinch rollers applied to the delivery roller, by pivoting the switching means between the first position and the second position; and (d) unlock means for unlocking the pinch roller unit locked by the lock means when the switching means is operated to pivot from the second position to the third position.

According to the invention, by pivoting the switching means between the first position and the second position with the pinch roller unit locked at a locked position by the lock means, the pressing force of the pinch rollers applied to the delivery roller can be switched between two levels and, more concretely, the pressing force is set to the high level when thick paper is being delivered and to the low level when paper of normal thickness is being delivered. When the switching means is operated to pivot from the second position to the third position, the unlock means releases the pinch roller unit from the condition where it is locked by the lock means so that the pinch roller unit is opened. Accordingly, one switching means is used for switching the pressing force of the pinch rollers between the high and low levels and for unlocking the pinch roller unit, which enables a simple-structured, low-cost paper delivery device made up of less components. By employing such a paper delivery device, an image forming apparatus can be made in a compact size and economically manufactured as a whole.

Preferably, the paper delivery device of the invention further includes paper restraining means for pressing the paper against either of the paper guides to restrain the paper just before the pinch roller unit is unlocked by the unlock means. The use of the paper restraining means prevents the paper bearing unfixed images from rising up and from rubbing against the paper guides or other members when the pinch roller unit is opened for a check of printing quality.

The paper restraining means may be designed to release the paper from its restrained condition when the switching means is operated to pivot to the first position, with the pinch roller unit being unlocked by the unlock means. This allows the paper to be released from the restraint when the pinch roller unit is open, so that jammed paper can be easily removed while the pinch roller unit is open.

Preferably, the paper restraining means releases the paper from its restraint condition just before locking of the pinch roller unit by the lock means when the pinch roller unit is brought into the locked condition from an unlocked condition.

The pressing force changing means may be composed of: (a) a cam shaft which is pivoted when the switching means is operated; (b) a cam secured to the cam shaft; (c) a leaf spring fixture which is pivoted to a predetermined angular position, being engaged with the circumferential face of the cam; and (d) leaf springs attached to the leaf spring fixture to press the pinch rollers against the delivery roller.

The first position may be a position where the pressing force of the pinch rollers is great while the second position may be a position which is about 90° apart from the first position and where the pressing force of the pinch rollers is small.

The lock means may be composed of: (a) a lock shaft provided in the pinch roller unit; (b) locking members pivotably supported by a main body frame and each having an engagement recess portion to stop the lock shaft by engagement; and (c) a coil spring for energizing the locking members in the direction in which the locking members stop the lock shaft by engagement.

The unlock means may be composed of: (a) a hardware which is pivoted when the switching means is operated; and (b) a lever which is pressed by the hardware at a predetermined position to pivot in integral relationship with the locking members.

The paper restraining means may be composed of: (a) a leaf spring fixture which is pivoted when the switching means is operated; and (b) leaf springs which are attached to the leaf spring fixture to press the paper when the leaf spring fixture is pivoted. Preferably, the leaf spring fixture is energized by a coil spring in the direction in which the leaf springs press the paper and is provided with a pressing piece which presses the leaf spring fixture against the energizing force.

Preferably, the paper delivery device of the invention further comprises a paper jam detecting sensor positioned downstream of the pinch rollers and having a rotating body which moves following the movement of the paper. It is also preferable that the paper delivery device includes pressing means for pressing the paper when it travels under the paper jam detecting sensor. If the paper is entrapped or pushed back in the downstream of the paper delivery device such as in the stacker unit, the paper jam detecting sensor is often affected. The adverse effects of entrapment and push back can be prevented by the pressing means, so that erroneous detection by the paper jam detecting sensor can be avoided. It is preferable that the pressing means be formed from a number of strip-like synthetic resin sheets. Such synthetic resin sheets are preferably disposed in gaps between the successive pinch rollers. It is also preferable that each upstream end of the synthetic resin sheet with respect to the delivery direction of the paper is fixed to the under-side of the upper paper guide. The downstream ends of each synthetic resin sheet with respect to the delivery direction of the paper is preferably bent upward, which prevents the paper from rubbing against the leading ends of the sheets, so that the printed images on the paper will not be adversely affected.

The pinch rollers are paired, and the successive pairs of pinch rollers may be aligned in staggered arrangement in relation to the delivery roller along the paper delivery direction. Such arrangement increases the contact area of the paper and the delivery roller, ensuring stable delivery force. Another advantage is such that the number of pinch rollers, which come in contact with the paper when the paper enters the delivery roller and when the perforations formed on the paper pass the delivery roller, can be reduced to half of that in the conventional device, which reduces the pressure (load) of the pinch rollers imposed on the paper. This is effective in preventing slippage of the rollers and therefore stabilizes the behavior of the paper so as to travel in one direction. In addition, when the delivery of the paper is diverted to a direction toward the delivery roller, such diversion can be carried out with a small number of rollers.

Other objects of the present invention will become apparent from the detailed description given hereinafter. However, it should be understood that the detailed description and specific example, while indicating a preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and accompanying drawings which are given by way of illustration only, and thus are not limitative of the present invention, and wherein:

FIG. 1 illustrates the whole structure of an image forming apparatus according to the embodiment of the invention;

FIG. 2 is a plan view of a paper delivery device according to the embodiment of the invention;

FIG. 3 is a view taken in the direction of arrow A of FIG. 2;

FIG. 4 is a partially broken view taken in the direction of arrow B of FIG. 2;

FIG. 5 is a partially enlarged view of FIG. 2;

FIGS. 6(*a*) through 6(*c*) show a first set of explanatory diagrams illustrating pinch pressure changing operation and pinch roller unit unlocking operation;

FIGS. 7(*a*) through 7(*c*) show a second set of explanatory diagrams illustrating the pinch pressure changing operation and the pinch roller unit unlocking operation;

FIGS. 8(*a*) through 8(*c*) show a third set of explanatory diagrams illustrating the pinch pressure changing operation and the pinch roller unit unlocking operation;

FIGS. 9(*a*) through 9(*c*) show a fourth set of explanatory diagrams illustrating the pinch pressure changing operation and the pinch roller unit unlocking operation;

FIGS. 10(*a*) through 10(*c*) show a fifth set of explanatory diagrams illustrating the pinch pressure changing operation and the pinch roller unit unlocking operation;

FIGS. 11(*a*) through 11(*c*) show a first set of explanatory diagrams illustrating a pinch roller unit locking operation;

FIGS. 12(*a*) through 12(*c*) show a second set of explanatory diagrams illustrating the pinch roller unit locking operation;

FIGS. 13(*a*) through 13(*c*) show a third set of explanatory diagrams illustrating the pinch roller unit locking operation;

FIG. 14 is a sectional view showing the surroundings of a paper jam detecting sensor;

FIG. 15 is a partially sectional view showing a modified example of sheet configuration;

FIG. 16 is a plan view showing one example of sheet arrangement;

FIG. 17 is a plan view showing the arrangement of pinch rollers; and

FIG. 18 is an explanatory diagram of a prior art paper delivery device.

DESCRIPTION OF THE PREFERRED EMBODIMENT

Figure 1:
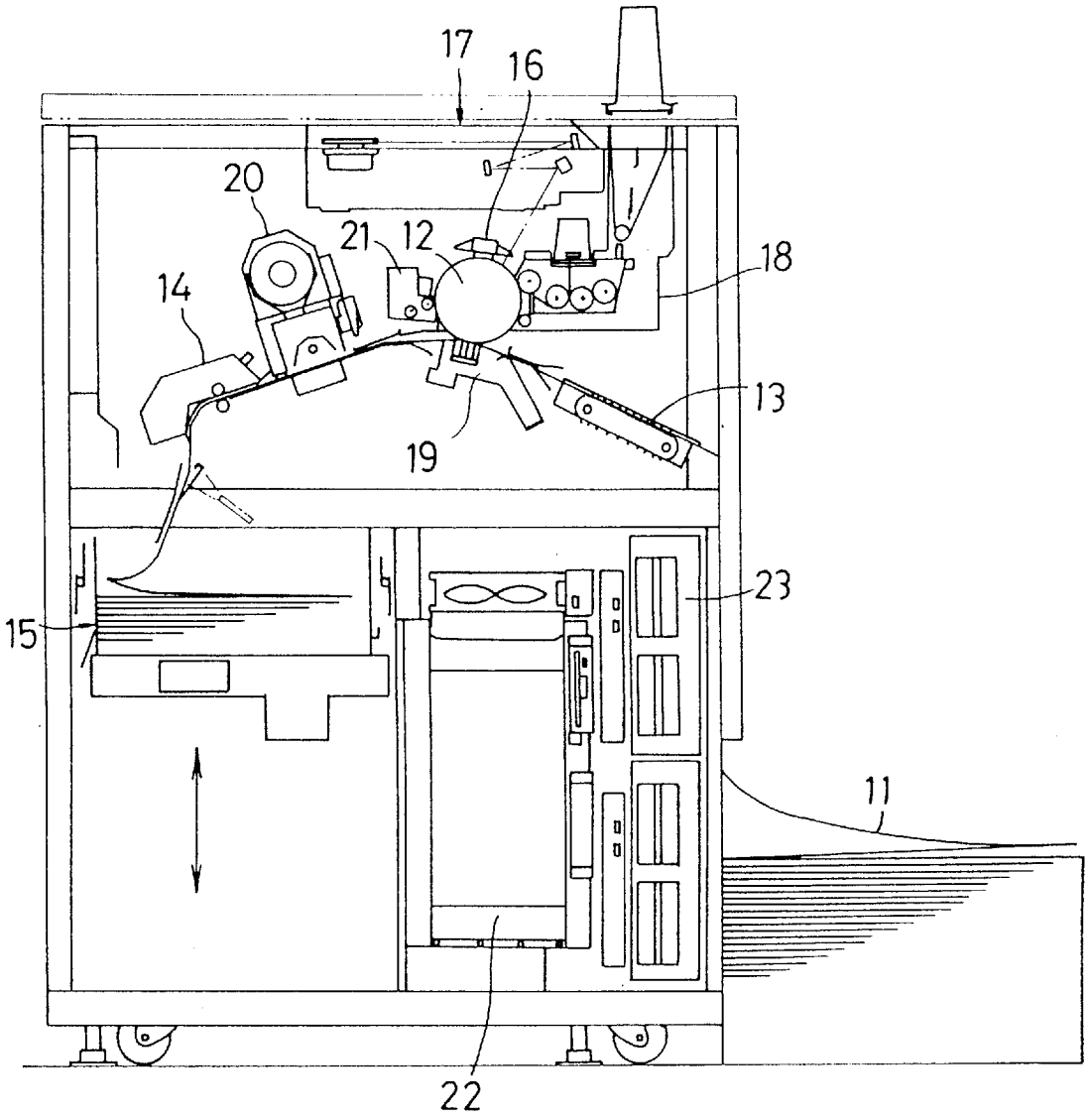
FIGS. 1 to 18 provide illustrations of a preferred embodiment of the invention.

Referring now to the drawings, a preferred embodiment of a paper delivery device according to the invention will be explained below.

FIG. 1 shows an image forming apparatus according to the invention, in which as a delivery means for continuous paper 11 (hereinafter referred to as "paper"), a tractor unit 13 is disposed upstream of a photosensitive drum 12 in the paper delivery direction and a scuff roller unit 14 is disposed downstream of the drum 12. On the downstream side of the scuff roller unit 14, there is provided a stacker unit 15 onto which the paper 11 is stacked, being folded such that the front and back faces of the paper 11 alternately face up. Disposed around the photosensitive drum 12 are (i) a front charger 16 for uniformly, electrically charging the surface of the photosensitive drum 12, (ii) an optical system 17 for directing light to areas other than an image portion on the surface of the photosensitive drum 12 electrically charged by the front charger 16, in order to form an electrostatic latent image, (iii) a developing device 18 for forming a visible image by applying toner to the electrostatic latent image formed by the optical system 17, the toner being opposite to the electrostatic latent image in polarity, (iv) a transfer guide unit 19 for transferring the toner image formed by the developing device 18 onto the paper 11 with the help of static electricity, by overlaying the paper 11 on the toner image and then applying polarity opposite to that of the toner to the back face of the paper 11, (v) a fixing unit 2() for fusing the transferred toner image by means of heat or pressure to permanently fix it on the paper 11, and (vi) a cleaner 21 for removing residual toner which has not been transferred but remained on the photosensitive drum 12. Note that reference numerals 22 and 23 in FIG. 1 denote a control unit and an interface unit, respectively.

Figure 2:
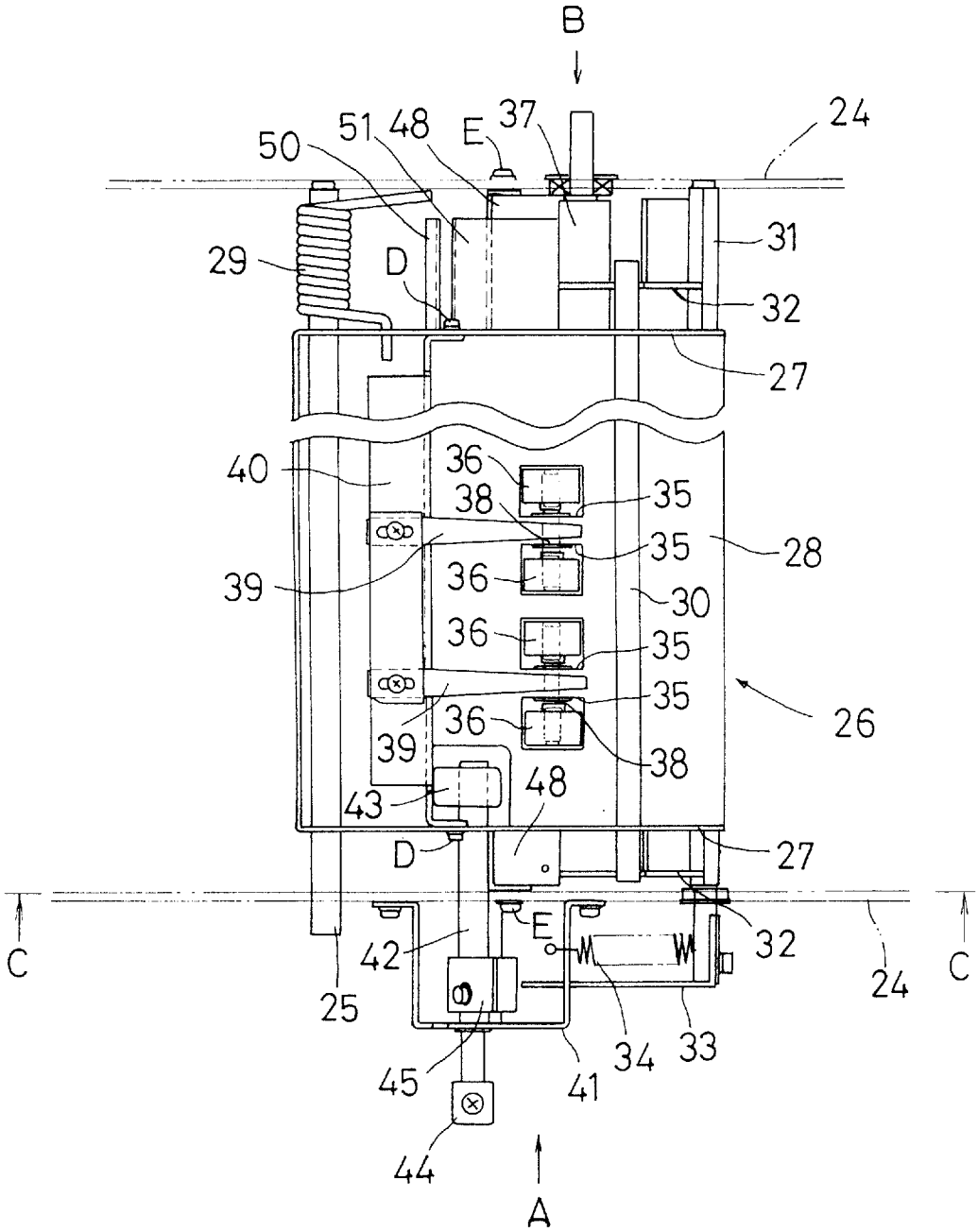
Figure 3:
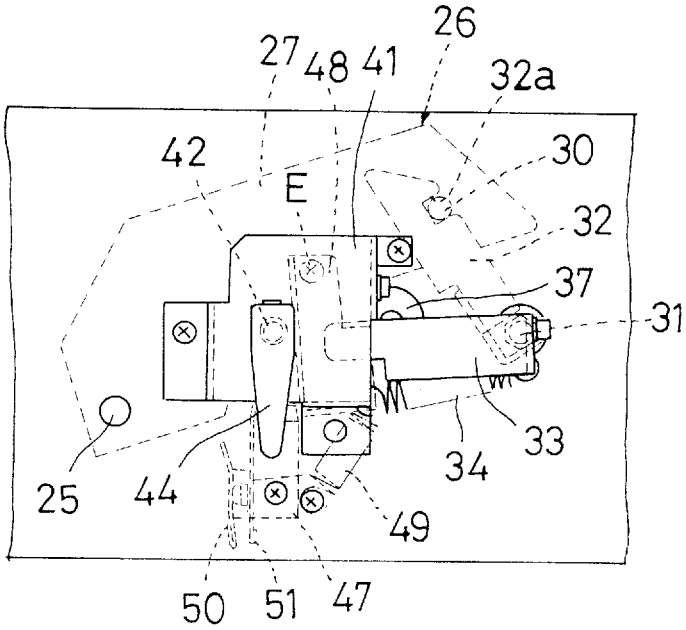
Figure 4:
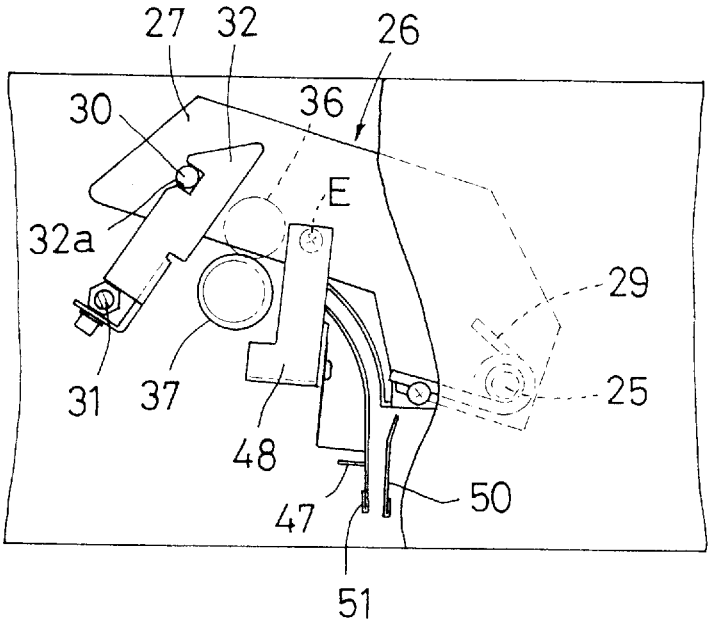
Figure 5:
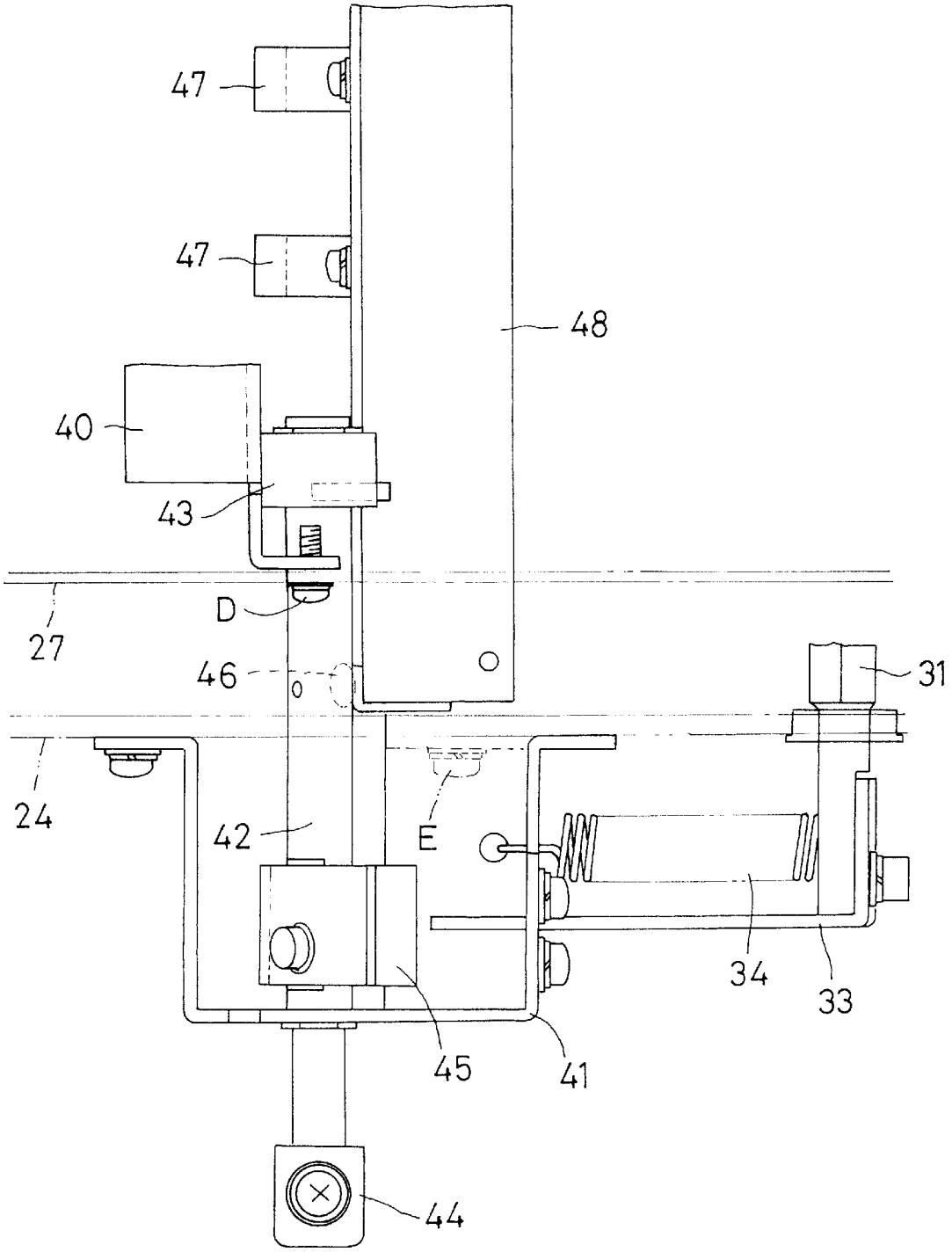

FIG. 2 shows a plan view of a paper delivery device according to this embodiment which is disposed in the scuff roller unit 14. FIG. 3 is a view taken in the direction of arrow A of FIG. 2; FIG. 4 is a partially broken view taken in the direction of arrow B of FIG. 2; and FIG. 5 is a partially enlarged view of FIG. 2.

In the paper delivery device of this embodiment, a pinch roller unit 26 is supported, as shown in FIG. 2, so as to pivot on a shaft 25, between an upper unlocked position and a lower locked position (shown in FIGS. 3 and 4), in relation to a main body frame 24 of the image forming apparatus.

The pinch roller unit 26 includes a unit frame 27 and a guide plate 28 fixedly attached to the bottom wall of the unit frame 27. The unit frame 27 is energized toward the upper unlocked position all the time by means of the energizing force of a torsion coil spring 29 wound around the shaft 25. Secured to the unit frame 27 is a lock shaft 30 that is positioned in parallel with and upstream of (with respect to the paper delivery direction) the shaft 25. A shaft 31 parallel with the shaft 25 is supported by the main body frame 24 and provided with two locking members 32. Each locking member 32 has, at the leading end thereof, an engagement recess portion 32*a* for stopping the lock shaft 30 by engagement.

The shaft 31 is energized by a coil spring 34, which is tensioned between a lever 33 secured to one end of the shaft 31 and a cam shaft fixture 41 (to be described later), to pivot in the direction in which the locking members 32 are pressed against the lock shaft 30. This allows the lock shaft 30 to fit in the engagement recess portions 32*a* of the locking members 32 so that the pinch roller unit 26 is locked at the locked position, against the energizing force of the torsion coil spring 29, when the paper delivery device is in a normal paper delivery state.

The guide plate 28 has a number of holes 35 at the substantially center thereof. These holes 35 are aligned in the longitudinal direction of the guide plate 28. Pairs of pinch rollers 36 are supported in such a manner that each pinch roller 36 faces each of the holes 35, being vertically movable. For letting the pinch rollers 36 apply pressing force (pinch pressure) to a delivery roller 37, support shafts 38 for the pairs of pinch rollers 36 are respectively pressed by leaf springs 39. These leaf springs 39 are attached to a leaf spring fixture 40 which is attached to the unit frame 27 so as to pivot on supporting point D. The position of each leaf spring 39 is adjustable. With this arrangement, the pressing force of the pinch rollers 36 to be applied to the delivery roller 37 can be adjusted by changing the pivotal angle of the leaf spring fixture 40 in relation to the unit frame 27.

The cam shaft fixture 41 projects from the front face of the main body frame 24 and a cam shaft 42 is pivotably supported between the main body frame 24 and the cam shaft fixture 41. Secured to the leading end of the cam shaft 42 is a cam 43 which comes in sliding contact with the leaf spring fixture 40 to change the pivotal angle of the leaf spring fixture 40, thereby changing the pressing force of the pinch rollers 36 between two levels, that is, the high level and the low level. A switch lever 44 is fixedly attached to the base end of the cam shaft 42 to pivot the cam shaft 42. A hardware 45 having a substantially L-shaped cross-section is provided at the substantially center of the cam shaft 42. This hardware 45 forces the lever 33 down when it is positioned at a predetermined pivotal position and comes into engagement with the cam shaft fixture 41 when it is at another predetermined pivotal position. At an appropriate position of the cam shaft 42, a screw 46 is disposed for pressing a leaf spring fixture 48 (to be described later).

The leaf spring fixture 48 having a plurality of leaf springs 47 attached thereto is supported on the main body frame 24 so as to pivot on supporting point E, as shown in FIG. 5. The leaf spring fixture 48 is energized by a coil spring 49 to pivot clockwise in FIG. 3 (counterclockwise in FIG. 4) and the coil spring 49 is attached, at one end, to an appropriate position of the leaf spring fixture 48 while the other end is attached to the main frame 24. The leaf spring fixture 48 comes in contact with the cam shaft 42 or the screw 46 secured to the cam shaft 42, whereby the leaf spring fixture 48 is prevented from pivoting more than a specified angle. When the leaf spring fixture 48 is in contact with the circumferential face of the cam shaft 42, the leaf springs 47 restrain the paper 11 being guided along paper guides 50, 51. When the leaf spring fixture 48 is brought into contact with the head of the screw 46 by the pivot of the cam shaft 42, the leaf springs 47 are retracted from the paper guides 50, 51, releasing the paper 11 from the restraint by the leaf springs 47. The stiffness of the coil spring 49 is set such that the cam shaft 42 would not pivot even if the screw 46 is pushed by the energizing force of the coil spring 49 through the leaf spring fixture 48.

Reference is now made to FIGS. 6 to 13 for describing operations in the paper delivery device having the above arrangement, that is, (i) pinch pressure changing operation by the switch lever 44, (ii) unlocking of the pinch roller unit 26 and (iii) locking of the pinch roller unit 26 by pressing the pinch roller unit 26 when it is in an unlocked condition. Note that FIGS. 6(*a*) to 13(*a*) are views taken in the direction of arrow A of FIG. 2, FIG. 6(*b*) to 13(*b*) are sectional views taken along line C—C of FIG. 2, which mainly illustrate the action of the pinch rollers 36 and FIG. 6(*c*) to 13(*c*) are sectional views taken along line C—C of FIG. 2, which mainly illustrate the action of the leaf springs 47 for restraining the paper 11.

First, changing of pinch pressure and unlocking of the pinch roller unit 26 will be described with reference to FIGS. 6 to 10.

Figure 6:
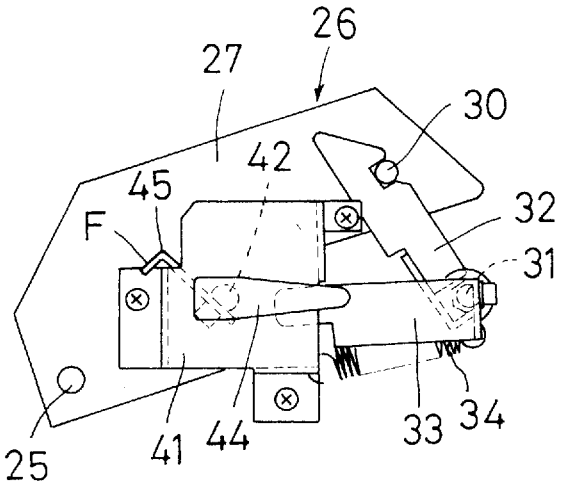
Figure 6:
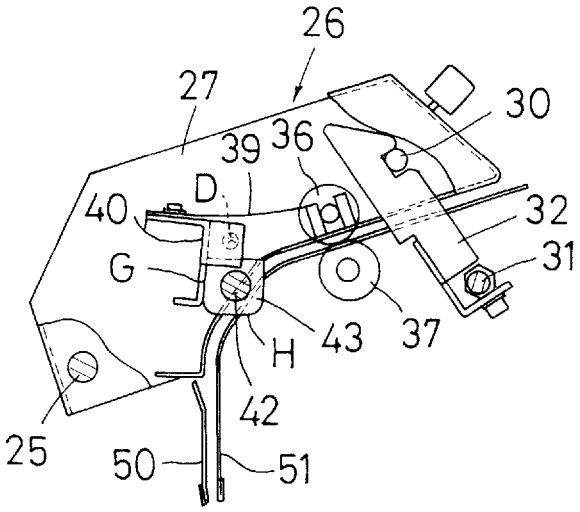
Figure 6:
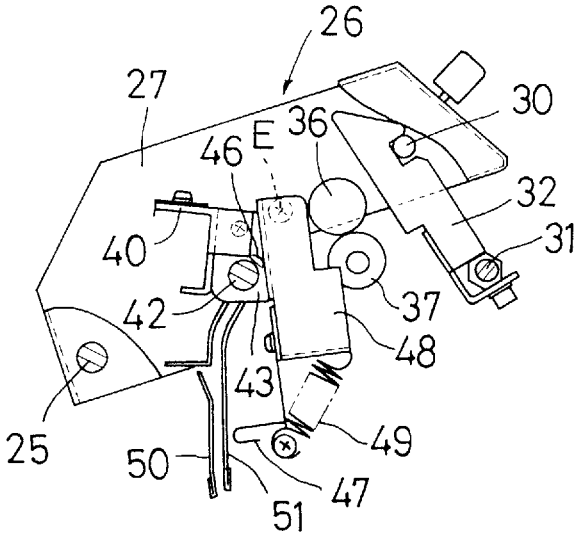

In the condition where the switch lever 44 is directed to the right (this position is for the case where thick paper is used) as shown in FIG. 6, G face (=the farthest face from the center of the cam shaft 42) of the cam 43 is in contact with the leaf spring fixture 40, thereby to pivot the leaf spring fixture 40 about supporting point D to a position at which the leaf springs 39 are most fully deflected, so that high pinch pressure is obtained. At that time, the locking members 32 pivotable on the shaft 31 are pushed toward the lock shaft 30 by the coil spring 34 attached to the lever 33, thereby restraining the lock shaft 30 and therefore the pinch roller unit 26 is not released from its locked condition. The leaf spring fixture 48, which is pivotable on supporting point E, is pulled clockwise by the coil spring 49. However, this leaf spring fixture 48 is pushed counterclockwise by means of the screw 46 fixed to the cam shaft 42 so that the leaf springs 47 are retracted from the paper guides 50, 51. Note that when the switch lever 44 is at the position shown in FIG. 6(*a*), the switch lever 44 does not further pivot counterclockwise, since the hardware 45 secured to the cam shaft 42 is in contact with the cam shaft fixture 41 at F point.

Figure 7:
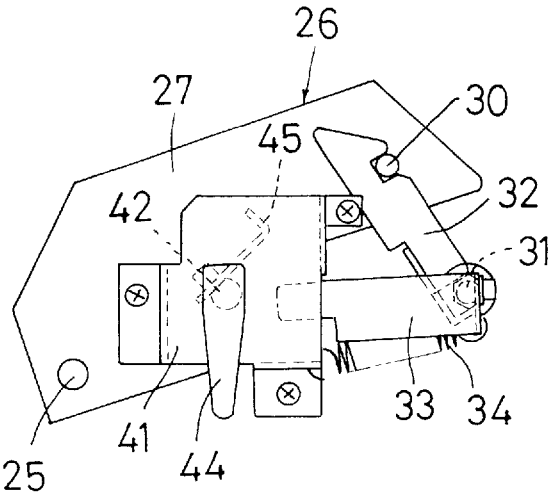
Figure 7:
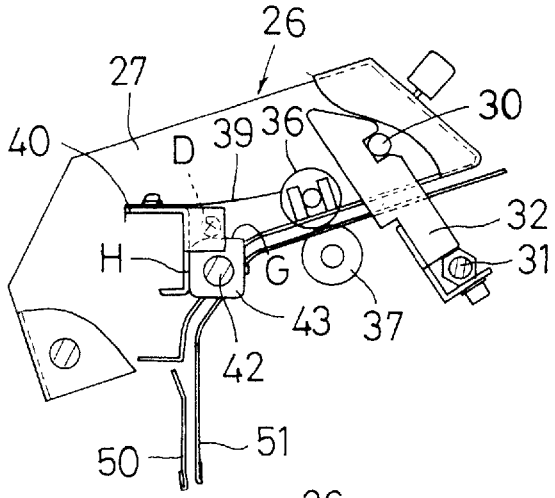
Figure 7:
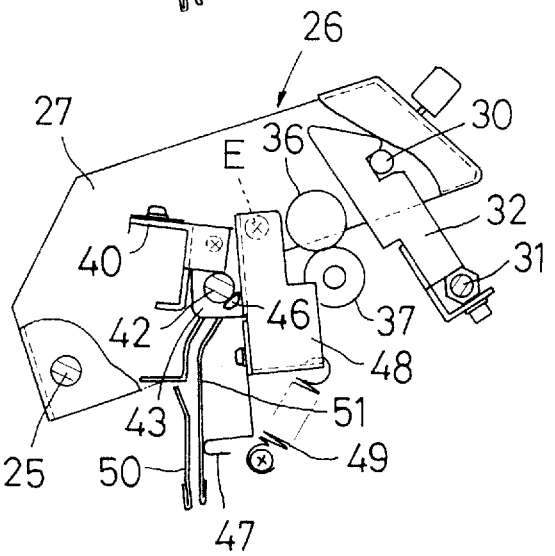

If the switch lever 44 is pivoted from the above-described position where pinch pressure is high into the facing-down position shown in FIG. 7 (this position is for the case where paper of normal thickness is used), the cam shaft 42 pivots through 90° so that the contact face of the leaf spring fixture 40 in relation to the cam 43 is changed to H face which is nearer to the center of the cam shaft 42 than G face and therefore the leaf springs 39 are less deflected compared to the condition shown in FIG. 6. In this condition, pinch pressure is low. At that time, the locking members 32 are pushed toward the lock shaft 30 by the coil spring 34, restraining the lock shaft 30, just like the case described earlier. Therefore, the pinch roller unit 26 is not released from its locked condition. Although the position of the screw 46 has been changed by the pivot of the cam shaft 42 through 90°, the leaf spring fixture 48 is still pushed counterclockwise by means of the screw 46 as shown in FIG. 7(*c*) and therefore the leaf springs 47 are still retracted from the paper guides 50, 51.

Figure 8:
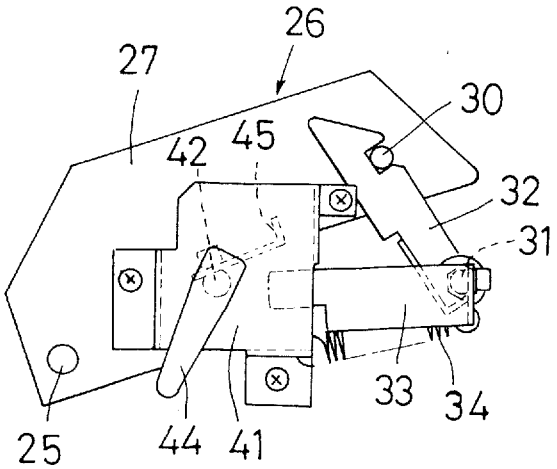
Figure 8:
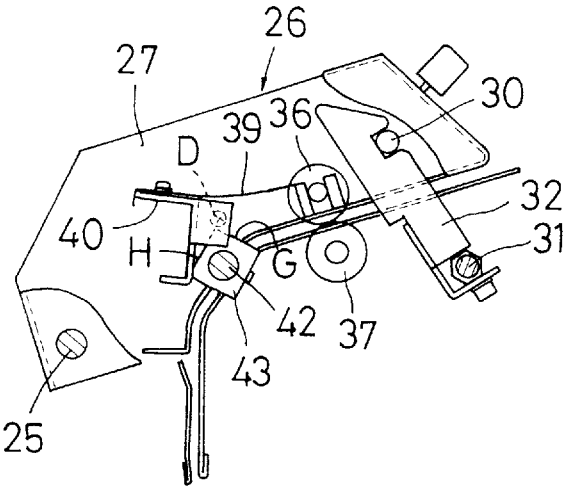
Figure 8:
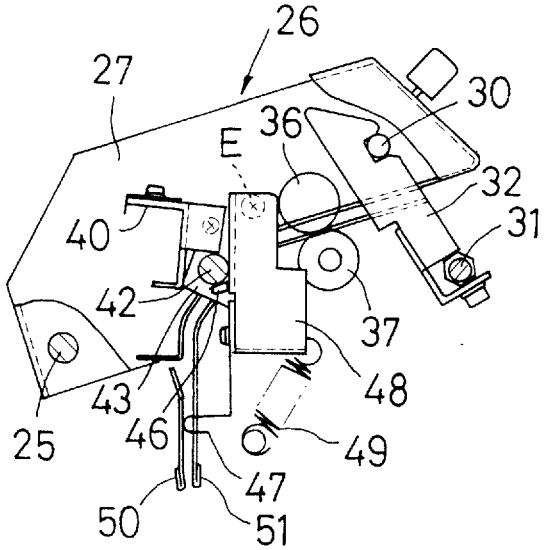

If the switch lever 44 is further pivoted clockwise as shown in FIG. 8 from the position where pinch pressure is low, the cam shaft 42 pivots until the screw 46 gets out of contact with the leaf spring fixture 48. This allows the leaf springs 47 attached to the leaf spring fixture 48 to be pressed against the paper guide 50 by means of the energizing force of the coil spring 49, so that the paper 11 being guided along the paper guides 50, 51 is restrained. Note that the condition of the locking members 32 shown FIG. 8 is the same as shown in FIGS. 6 and 7, and therefore the pinch roller unit 26 is still in the locked condition.

Figure 9:
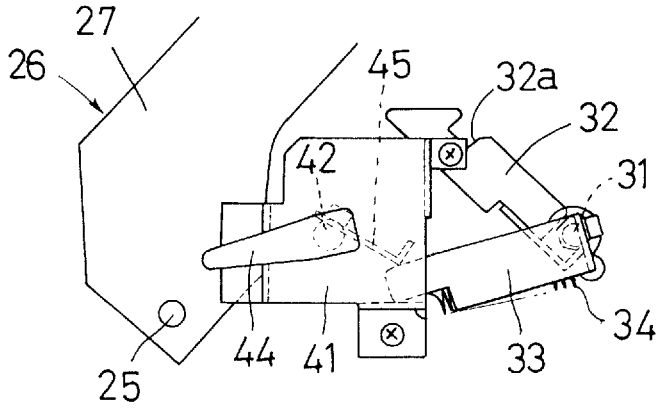
Figure 9:
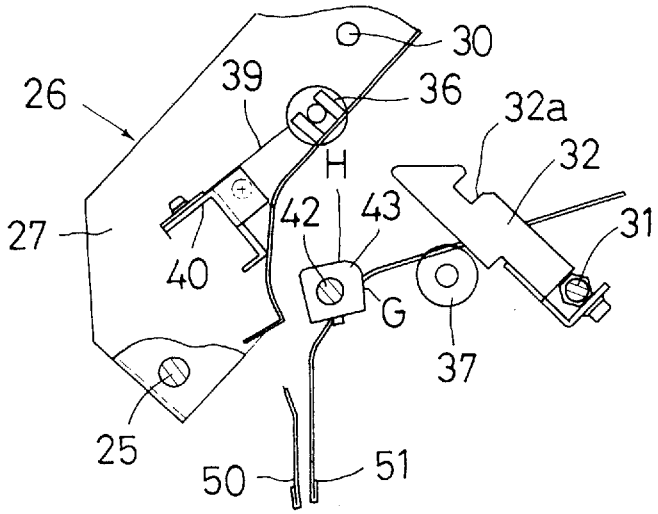
Figure 9:
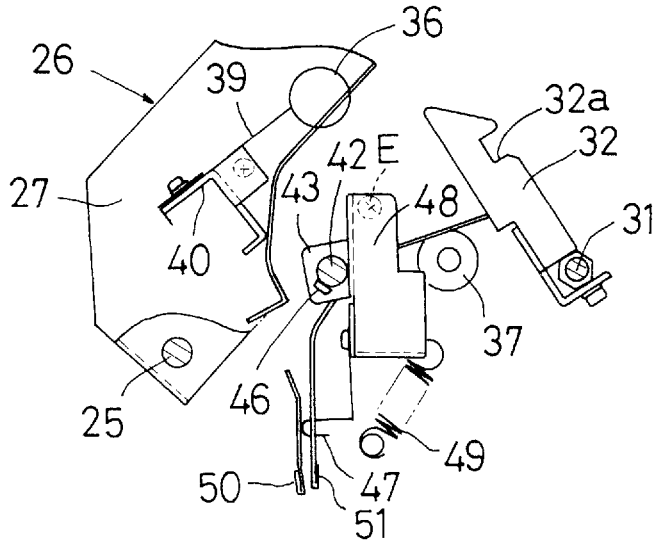

If the switch lever 44 is still further pivoted clockwise as shown in FIG. 9, the hardware 45 secured to the cam shaft 42 forces the lever 33 down, which causes the shaft 31 to pivot and the locking members 32 to pivot counterclockwise. This allows the lock shaft 30 to be released from the engagement with the engagement recess portions 32*a*, thus unlocking the pinch roller unit 26 to pivot to the open, unlocked position with the help of the energizing force of the torsion coil spring 29. At that time, the paper 11 is still restrained by the leaf springs 47, so that the portion of the unfixed image bearing paper 11 between the photosensitive drum 12 and the fixing unit 20 is prevented from rising up and from rubbing against the paper guides and other members.

Figure 10:
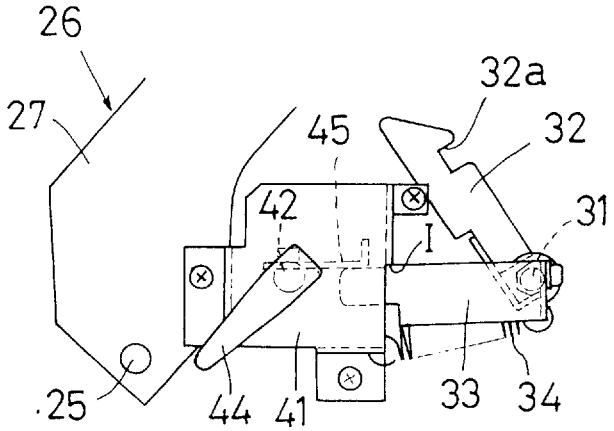
Figure 10:
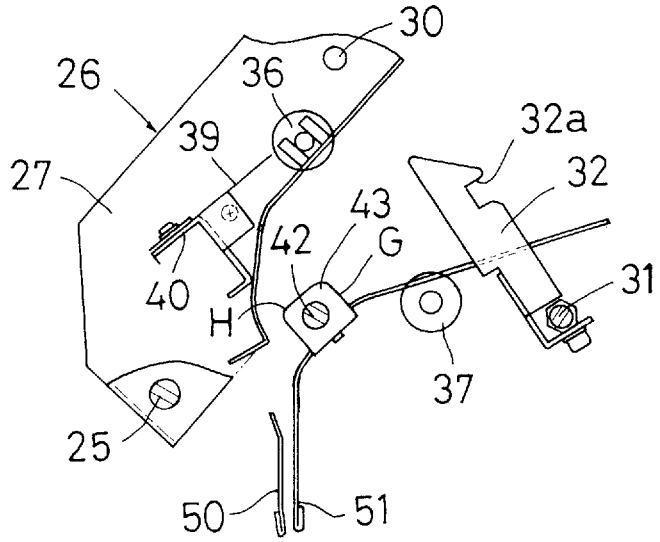
Figure 10:
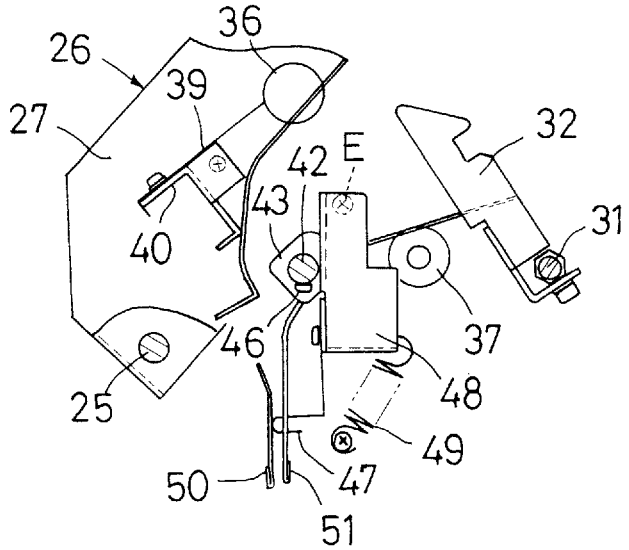

If the switch lever 44 looses the operator's hold in the condition shown in FIG. 9, the lever 33 and the locking members 32 pivot clockwise with the help of the energizing force of the coil spring 34 as shown in FIG. 10, until the lever 33 comes in contact with the cam shaft fixture 41 at I point. Then, the screw 46 secured to the cam shaft 42 is brought into contact with the leaf spring fixture 48, which allows the switch lever 44 to be held at the position shown in FIG. 11 where the switch lever 44 is shifted leftward about 45° from its facing-down position.

Locking of the pinch roller unit 26 will be described with reference to FIGS. 11 to 13.

Figure 11:
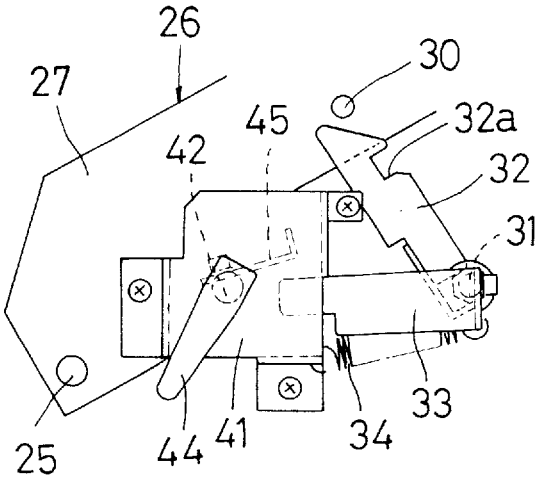
Figure 11:
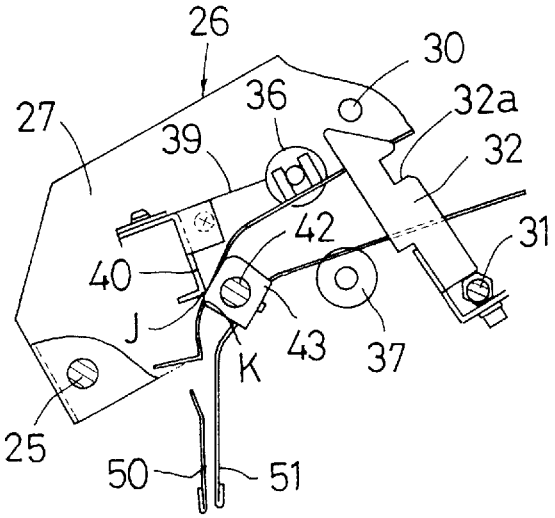
Figure 11:
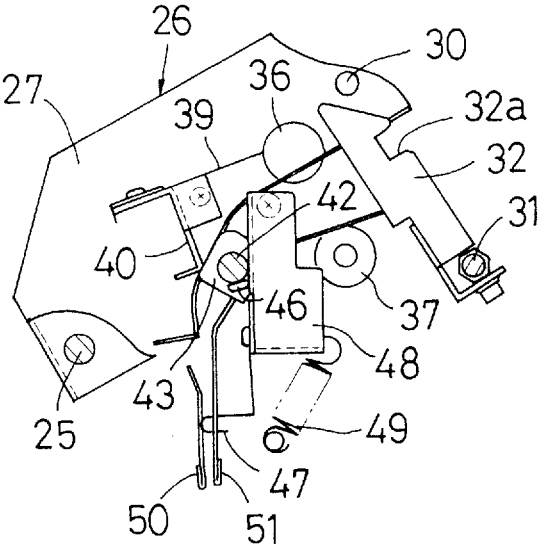

If the pinch roller unit 26 in its open, unlocked condition is pushed in a direction to be closed, J point of the leaf spring fixture 40 strikes against K point of the cam 43 as shown in FIG. 11, so that the leaf spring fixture 40 and the cam 43 both start pivoting. In this condition, the leaf springs 47 still restrain the paper 11.

Figure 12:
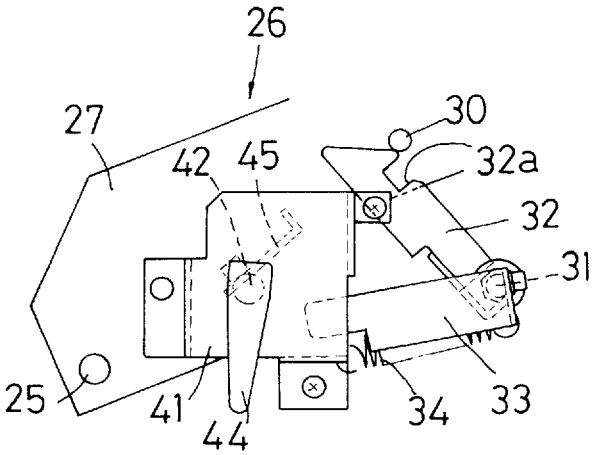
Figure 12:
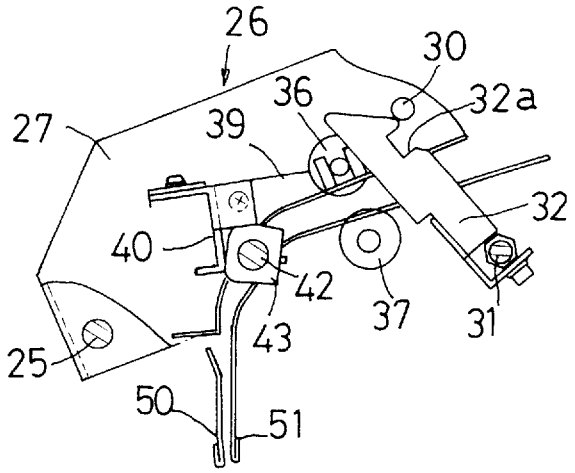
Figure 12:
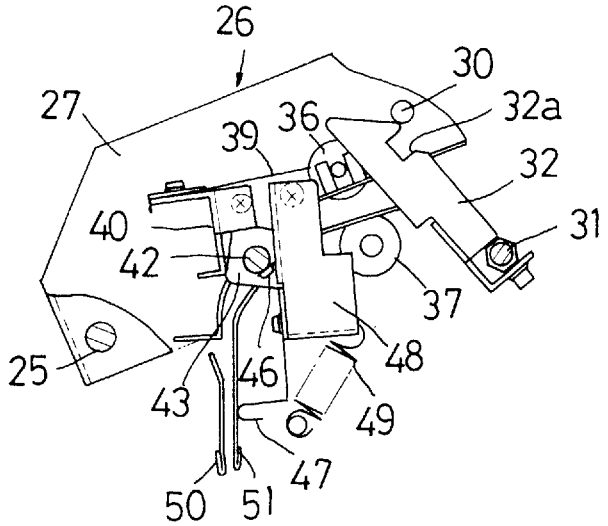
Figure 13:
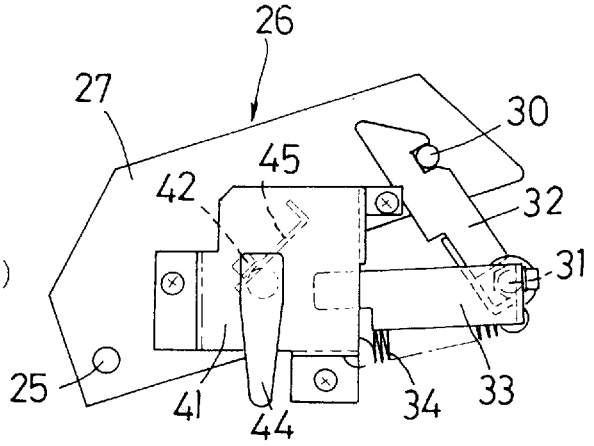
Figure 13:
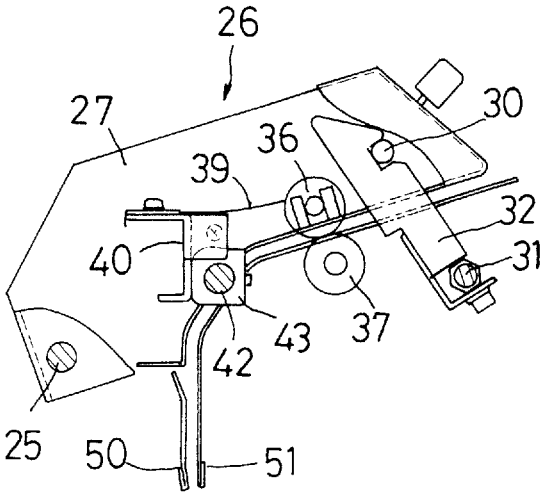
Figure 13:
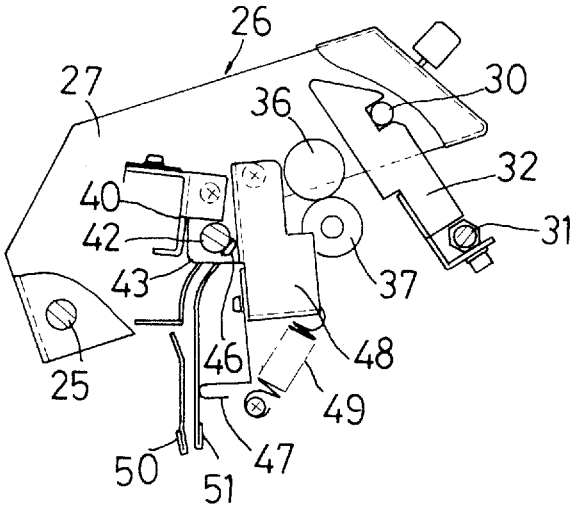

If the pinch roller unit 26 is further pushed in the direction to be closed, the leaf spring fixture 40 and the cam 43 further pivot as shown in FIG. 12, and the screw 46 forces the leaf spring fixture 48 up so that the leaf springs 47 are retracted from the paper guides 50, 51, releasing the paper 11 from the restraint. Closing the pinch roller unit 26 as described above allows the lock shaft 30 to force down the locking members 32 and the lever 33 counterclockwise and as a result, the pinch roller unit 26 is locked as shown in FIG. 13. Note that although the paper 11 is released from the restraint by the leaf springs 47 in the condition shown in FIG. 12, the paper 11 would not rise up because this condition takes place just before the pinch roller unit 26 is locked.

In the event that a paper jam occurs in the scuff roller unit 14, the switch lever 44 is operated to pivot to the position shown in FIG. 6 (i.e., high pinch pressure position), with the pinch roller unit 26 in its open condition (i.e., the condition shown in FIG. 10). Then, the cam shaft 42 pivots counterclockwise, causing the screw 46 secured to the cam shaft 42 to push the leaf spring fixture 48 counterclockwise. This allows the leaf springs 47 to be retracted from the paper guides 50, 51, thereby releasing the paper 11 from the restraint. Note that even when the cam 43 is in the position where pinch pressure is high such as when jammed paper is removed, it is possible to close the pinch roller unit 26. At that time, the switch lever 44 does not pivot, staying at the position where pinch pressure is high.

Figure 14:
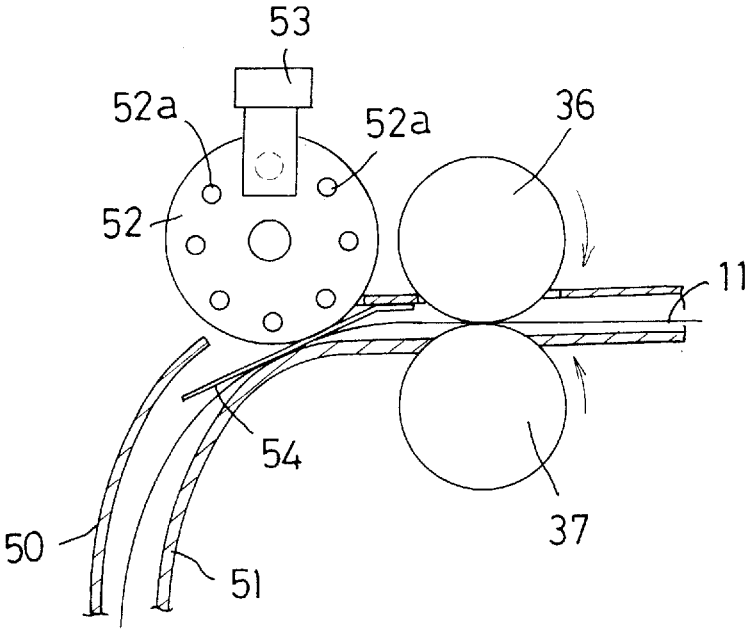

Referring to FIG. 14, the surroundings of the paper jam detecting sensor, which is conventional in the arts disposed downstream of the pinch rollers 36 will be explained.

As shown in FIG. 14, a roller 52 having a number of holes 52*a* at its periphery is positioned on the somewhat downstream side of the pinch rollers 36 so as to project through a gap in the upper guide 50 into a space between the paper guides 50 and 51. The roller 52 is pressed against the lower guide 51 by a spring or its own weight such that it rotates, following the movement of the paper 11 being delivered along the paper guides 50, 51. A photointerrupter 53, positioned a certain distance away from the roller 52, detects the rotational period of the holes 52*a* to obtain changes in the rotational speed of the roller 52. By this detection, it can be determined whether or not a paper jam has occurred.

Since such a paper jam detecting sensor is likely to make erroneous detection when the paper 11 is caught by the stacker unit 15 positioned downstream of the sensor and pushed back, in order to prevent rising up of the paper 11 located in the neighborhood of the roller 52, a number of flexible, deformable, strip-like sheets 54 made from a synthetic resin (e.g., polyester film) are affixed to the underside of the upper paper guide 50, and by the use of these sheets 54, the paper 11 is pressed against the lower paper guide 51. The upstream end of each sheet 54 is attached to the paper guide 50 and the gap between each sheet 54 and the paper guide 51 is gradually narrowed down toward its downstream end. The thickness of the sheets 54 is preferably in the range of 0.1 mm to 0.3 mm.

The use of the sheets 54 prevents rising up of the paper 11 even if the paper 11 is caught by the stacker unit 15 and pushed back toward the roller 52, so that erroneous detection can be securely prevented. By forming the sheets 54 from a polyester film, the friction between the sheets 54 and the paper 11 can be reduced, which prevents not only the adverse effects of the sheets 54 to the paper 11 but also wear of the sheets 54.

Figure 15:
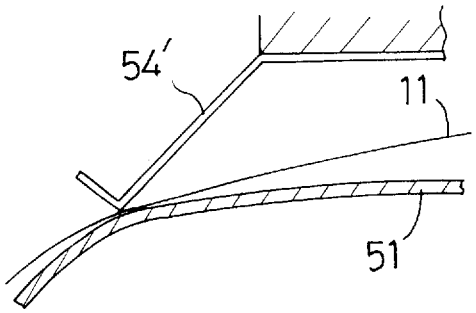

FIG. 15 shows a modified example of the sheets 54. In this example, the leading ends of the sheets 54' are bent such that the gaps between the downstream ends of the sheets 54' and the paper 11 are gradually widened. This prevents the leading ends of the sheets 54' from rubbing against the paper 11 when the paper 11 is delivered backward, and thus, the printing face of the paper 11 can be protected.

Figure 16:
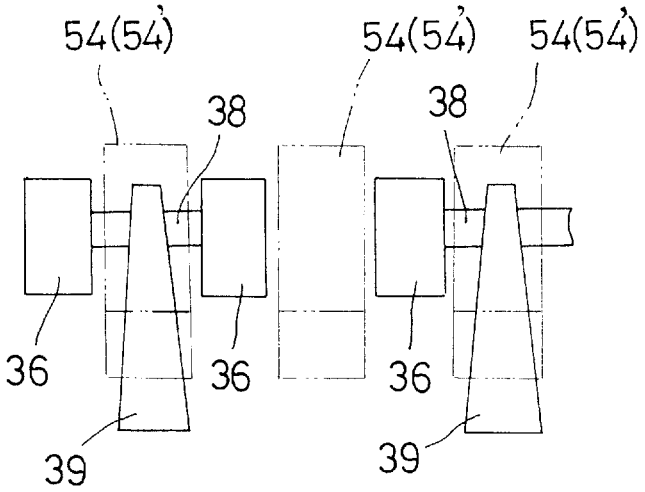

In cases where the roller 52 and the pinch rollers 36 are close to each other, the sheets 54 (54') are preferably positioned in the gaps between the successive pinch rollers 36 as shown in FIG. 16.

Figure 17:
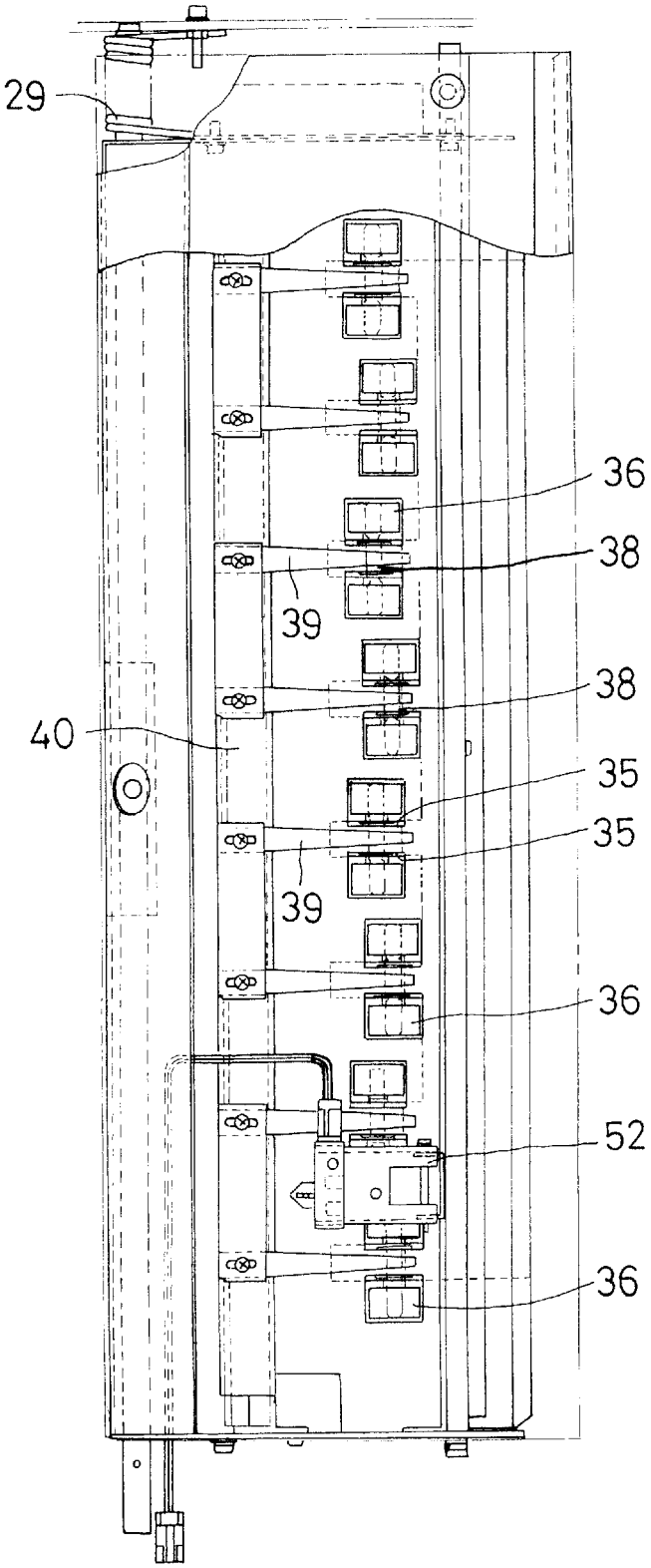
Figure 18:
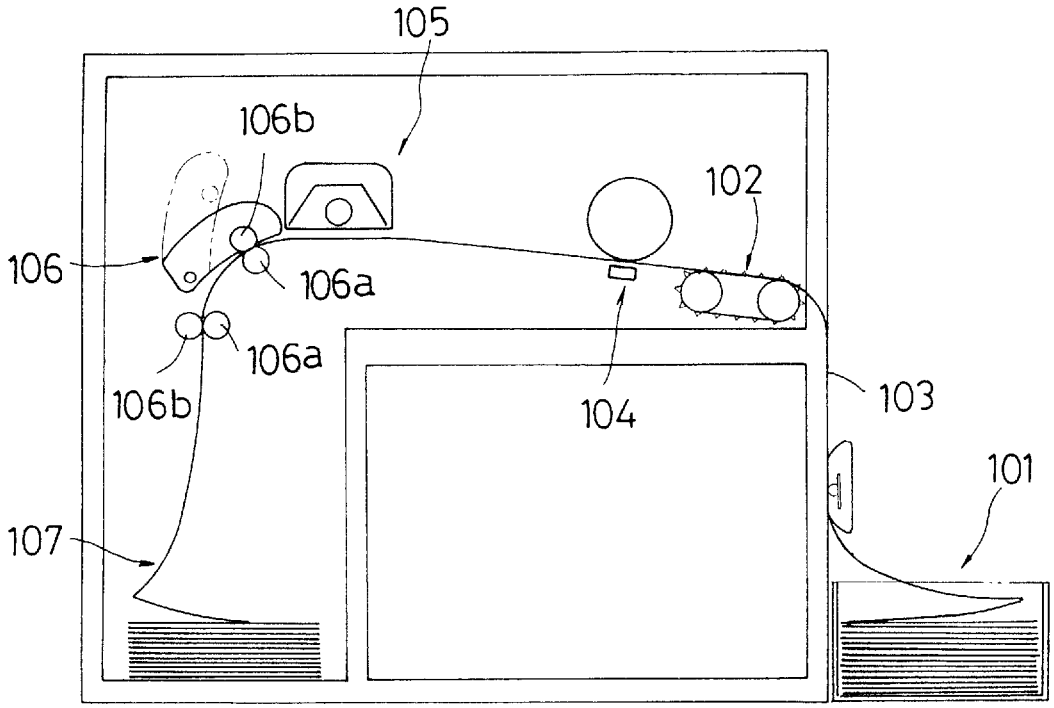
PRIOR ART FIG. 18

While the axes of the successive support shafts 38 for pairs of pinch rollers 36 coincide with one another in the foregoing embodiment, the axes of the successive support shafts 38 could be disposed in staggered arrangement, being shifted back and forth in relation to the delivery roller 37 as shown in FIG. 17.

With the staggered arrangement of the pairs of pinch rollers 36, the contact area of the paper 11 and the delivery roller 37 can be increased and therefore stabler delivery force can be achieved. This arrangement also reduces the number of pinch rollers 36, which come in contact with the paper 11 when the paper 11 enters the delivery roller 37 and the perforations formed on the paper 11 pass the delivery roller 37, to half of that in the conventional delivery device. This advantageously reduces the pressure (load) of the pinch rollers 36 imposed on the paper 11. As a result, slippage of the paper 11 can be prevented and the behavior of the paper 11 can be stabilized so as to travel in one direction. Further, when the delivery of the paper 11 is diverted to a direction toward the delivery roller 37, the conventional roller arrangement requires that many rollers should be disposed along the delivery direction of the paper 11 and the delivery direction should be gradually changed by the use of such rollers. On the other hand, the staggered arrangement can change the delivery direction of the paper 11 with a small number of rollers, because the paper 11 can change its travel direction, being pressed by the pinch rollers 36 which are followers of the paper 11.

It should be understood that the switch lever 44 corresponds to the switching means, while the lock shaft 30, the locking members 32 and the coil spring 34 correspond to the lock means, and that the cam shaft 42, the cam 43, the leaf spring fixture 40 and the leaf springs 39 correspond to the pressing force changing means, while the lever 33 and the hardware 45 correspond to the unlock means.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A paper delivery device in which paper is delivered, the device comprising:

pinch rollers;

a delivery roller, the paper being placed between the pinch rollers and the delivery roller;

lock means for locking the paper delivery device in a locked position;

pressing force changing means for changing the pressing force of the pinch rollers to at least one of a first pinch pressure and a second pinch pressure which is less than the first pinch pressure;

unlock means for unlocking the paper delivery device locked by the lock means; and a lever, operably coupled to said pressing force changing means and said unlock means, for causing the pressing force changing means to change the pressing force to the first and second pinch pressing when the lever is respectively in a first and second position while the paper delivery device remains in the locked position and for activating said unlock means to unlock the paper delivery device when the lever is in a third position.

2. The paper delivery device as claimed in claim 1, further comprising paper restraining means for pressing the paper against either of upper and lower paper guides to restrain the paper when the lever is in the third position.

3. The paper delivery device as claimed in claim 2, wherein the paper restraining means does not restrain the paper when the lever is in at least one of the first position and the second position.

4. The paper delivery device as claimed in claim 2 or 3, wherein the paper restraining means includes:

a leaf spring fixture which is pivoted when the lever is operated; and leaf springs which are attached to the leaf spring fixture to pressingly restrain the paper when the lever is in the third position.

5. The paper delivery device as claimed in claim 4, wherein the leaf spring fixture is biased by a coil spring in the direction in which the leaf springs restrains the paper and is provided with a pressing piece which presses the leaf spring fixture against the leaf springs.

6. The paper delivery device as claimed in claim 1, wherein the pressing force changing means includes:

a cam shaft to which the lever is operably coupled and which is pivoted when the lever is operated;

a cam secured to the cam shaft;

a leaf spring fixture which is pivoted to a predetermined angular position when engaged by the circumferential face of the cam when the lever is in at least one of the first and second positions; and leaf springs attached to the leaf spring fixture to press the pinch rollers against the delivery roller to provide at least one of the first and second pinch pressures.

7. The paper delivery device as claimed in claim 1, further comprising:

a pinch roller unit; and a main body frames, and wherein the lock means includes:

a lock shaft provided in the pinch roller unit;

locking members pivotably supported by the main body frame and each locking member having an engagement recess portion to stop the lock shaft by engagement; and a coil spring biasing the locking members in the direction in which the locking members stop the lock shaft by engagement.

8. The paper device as claimed in claim 1, wherein the unlock means includes:

an hardware which is pivoted when the lever is operated and a second lever which is pressed by the hardware at a predetermined position to pivot in integral relationship with the lock means.

9. The paper delivery device as claimed in claim 1, wherein the device further comprises:

a paper jam detecting sensor positioned downstream of the pinch rollers and having a rotating body which moves, following the movement of the paper; and pressing means for pressing the paper when the paper travels under the paper jam detecting sensor.

10. The paper delivery device as claimed in claim 9, wherein the pressing means is composed of a number of strip-like sheets made from a synthetic resin.

11. The paper delivery device as claimed in claim 10, wherein the synthetic resin sheets are inserted in gaps between the successive pinch rollers.

12. The paper delivery device as claimed in claim 10 or 11, wherein the upstream end of each synthetic resin sheet with respect to the delivery direction of the paper is fixedly attached to the underside of the upper paper guide.

13. The paper delivery device as claimed in claim 12, wherein the downstream end of each synthetic resin sheet with respect to the delivery direction of the paper bends upward.

14. The paper delivery device as claimed in claim 1, wherein the pinch rollers are paired and the successive pairs of pinch rollers are disposed in staggered arrangement in relation to the delivery roller along the delivery direction of the paper.

15. A paper delivery device, comprising:

a lock to secure the paper delivery device along a delivery path of paper;

a pinch roller;

a delivery roller, the paper being delivered along the delivery path between the pinch roller and the delivery roller;

a first pressure device having a leaf spring forcing the pinch roller toward the delivery roller to apply at least one of a first pinch pressure and a second pinch pressure on the paper in the delivery path;

a cam shaft having a cam;

a second pressure device having a leaf spring to apply a third pinch pressure on the paper; and a lever connected to the cam shaft pivotable into:

a first position rotating the cam to engage the first pressure device for applying the first pinch pressure on the paper and to prevent the second pressure device from applying the third pinch pressure on the paper, while the delivery device is secured along the delivery path of the paper;

a second position rotating the cam to engage the first pressure device for applying the second pinch pressure less than the first pinch pressure on the paper and to prevent the second pressure device from applying the third pinch pressure on the paper, while the delivery device is secured along the delivery path of the paper; and a third position unlocking the lock to unsecure the paper delivery device from the secured position on the delivery path of the paper and allowing the second pressure device to apply the third pinch pressure on the paper.

* * * * *